United States Patent [19]

Rainer et al.

[11] Patent Number: 4,485,829

[45] Date of Patent: Dec. 4, 1984

[54] PROCESS FOR INCREASING THE FILLING POWER OF TOBACCO

[75] Inventors: Norman B. Rainer, Richmond; Dean M. Siwiec, Chesterfield, both of Va.

[73] Assignee: Philip Morris Incorporated, New York, N.Y.

[21] Appl. No.: 464,484

[22] Filed: Feb. 7, 1983

[51] Int. Cl.[3] ..... A24B 3/18

[52] U.S. Cl. ..... 131/291; 131/293; 131/903

[58] Field of Search ..... 131/291, 292, 293, 294, 131/295, 296, 900, 901, 902

[56] References Cited

U.S. PATENT DOCUMENTS

| | | | |
|---|---|---|---|
| 2,029,494 | 2/1936 | Loewenthal | 131/297 |
| 2,596,835 | 5/1952 | Sowa | 131/291 |
| 2,955,601 | 10/1960 | Frankenburg | 131/296 |
| 3,357,436 | 12/1967 | Wright | 131/291 |
| 3,842,846 | 10/1974 | Lazzlo | 131/291 |
| 3,931,824 | 1/1976 | Miano et al. | 131/359 |
| 4,040,431 | 8/1977 | Ashworth et al. | 131/291 |
| 4,044,780 | 8/1977 | Kelly | 131/291 |
| 4,250,898 | 2/1981 | Utsch et al. | 131/291 |
| 4,274,427 | 6/1981 | Lenvay | 131/293 |
| 4,333,484 | 6/1982 | Keritsis | 131/359 |
| 4,366,823 | 1/1983 | Rainer et al. | 131/291 |

FOREIGN PATENT DOCUMENTS

| | | | |
|---|---|---|---|
| 810203 | 2/1981 | Canada | 131/291 |
| 1331640 | 9/1973 | United Kingdom | 131/291 |

*Primary Examiner*—V. Millin

[57] ABSTRACT

A process is disclosed for increasing the filling power of tobacco by contacting the tobacco, preferably by dry blending, with at least one basic calcium compound in an amount such that the treated tobacco has a pH of at least about 8, and heating the tobacco in the presence of sufficient moisture to establish and maintain its OV value within the range of from about 14% to about 40% and at a temperature and for a time sufficient to increase the filling power of the tobacco. As an additional first step, the tobacco may be contacted with an acid to achieve a tobacco product of lighter color.

8 Claims, No Drawings

PROCESS FOR INCREASING THE FILLING POWER OF TOBACCO

BACKGROUND OF THE INVENTION

This invention relates to the art of increasing the filling power of tobacco. More particularly, this invention relates to a process whereby the filling power of tobacco is increased by contacting the tobacco with at least one basic calcium compound and then heating the tobacco in the presence of sufficient moisture to establish and maintain the moisture content of the tobacco between about 14 and 40%.

During curing, the moisture content of tobacco leaves is greatly reduced resulting in shrinkage of the leaf structure and a decrease in filling power. Additionally, the shredding or cutting techniques employed to convert cured tobacco leaves into filler may result in some lamination and compression of the tobacco, thereby decreasing the filling power even further. Many processes have been devised for increasing the filling power of cured tobacco for reasons well known in the art.

The heretofore known processes may be broadly characterized as involving penetration or impregnation of the tobacco with impregnants (blowing or puffing agents), which when removed during the subsequent expansion step, generate elevated pressure in and expand the tobacco. Among the impregnants which have been employed are pressurized steam, air, water, organic solvents, ammonia, carbon dioxide, combinations of ammonia and carbon dioxide, and compounds capable of liberating a gas when subjected to chemical decomposition, as by heating. Among the means disclosed for removing the impregnant to expand the cell walls are a sudden reduction in pressure, freeze-drying, convection heating, radiant transfer (infrared) and the application of a microwave field.

It is also known in the art to increase the filling power of tobacco by stiffening the tobacco. Such stiffening treatment may be applied in conjunction with an expansion process to maintain the tobacco in its expanded state after removal of the impregnant. One such process involves impregnating the tobacco with a solution (usually aqueous) of multivalent metal or organic acid salts, and then drying the tobacco. The tobacco is expanded by means of the solvent and, upon drying, the various salts and ions bind to the pectinaceous materials naturally occurring within tobacco to stiffen the pectins and prevent the tobacco from returning to its original unexpanded form. An increase in filling power of 5 to 25% is reported. The multivalent metal and organic acid salts specifically disclosed for use in this process are calcium acetate, calcium gluconate, calcium levulinate, aluminum citrate, potassium titanium oxalate, aluminum sulfate, potassium aluminum sulfate, ammonium aluminum sulfate, magnesium sulfate, diammonium magnesium sulfate, ferrous sulfate, hydrated ammonium aluminum sulfate, hydrated potassium aluminum sulfate, hydrated aluminum sulfate, hydrated potassium titanium oxalate, aluminum citrate, and calcium sulfamate. The amount of the multivalent metal or organic acid salts applied to the tobacco ranges from 0.2% to 7.5% by weight of the dry tobacco.

Other stiffening agents known in the art include polyfunctional carboxylic acids, carbonyl chloride, aldehydes, diammonium phosphate, ketenes, lactones and aldehydic and keto sugars. To achieve significant increase in filling power with these stiffening agents, the use of high temperatures and expansion techniques are disclosed.

The addition of alkaline earth metal salts for improving smoking characteristics is known in the art. Generally, the salts constitute 0.1 to 0.5% by weight of the final product.

It is also known to improve the mildness of reconstituted tobacco by adding a combination of carbon and alkaline earth oxides, bicarbonates, or hydroxides to the filler. Calcium and magnesium compounds are said to give good results. The carbon and alkaline earth additives constitute 2 to 50% by weight of the final product.

DEFINITIONS

As used herein, the following terms have the indicated meanings.

Filling Power

The ability of tobacco to form a firm cigarette rod at a given moisture content. A high filling power indicates that a lower weight of tobacco is required to produce a cigarette rod of a given circumference and length than is required with a tobacco of lower filling power. Filling power is increased by stiffening tobacco, by expanding tobacco, and by increasing the surface roughness of the tobacco so as to increase interparticle friction.

Cylinder Volume (CV)

The volume that a given weight of shredded tobacco occupies under a definite pressure. The CV value is expressed as cc/10 g. To determine this value, tobacco weighing 10.000 g is placed in a 3.358 cm diameter cylinder and the cylinder is vibrated for 30 seconds on a "Syntron" vibrator. The tobacco is then compressed by an 1875 g piston 3.33 cm in diameter, for 5 minutes. The resulting volume of tobacco is reported as cylinder volume. This test is carried out at standard environmental conditions of 23.9° C. and 60% relative humidity (RH). A high cylinder volume indicates a high filling power.

Equilibrium Cylinder Volume ($CV_{eq}$)

The cylinder volume determined after the tobacco has been equilibrated by conditioning at 23.9° C. and 60% RH for 18 hours.

Oven-Volatiles Content (OV)

A value indicating the moisture content (or percentage of moisture) of tobacco. It is determined by weighing a sample of tobacco before and after treatment for three hours in a circulating air oven at 100° C. The weight loss as a percentage of initial weight is the oven-volatiles content. The weight loss is attributable to volatiles in addition to water but OV is used interchangeably with moisture content and may be considered equivalent thereto since, at the test conditions, not more than about 1% of the tobacco weight is volatiles other than water.

Equilibrium Oven-Volatiles Content ($OV_{eq}$)

The OV value determined after the tobacco has been equilibrated by conditioning at 23.9° C. and 60% RH for 18 hours.

Specific Volume (SV)

The volume of a predetermined amount of tobacco divided by the weight of the tobacco. The SV value is expressed as cc/g. The "$SV_{acetone}$" value may be determined by a simple application of the weight in air versus weight in liquid method according to which a one-gram sample of tobacco is placed in a porous container which is then weighed, submerged in acetone, and reweighed. The "$SV_{Hg}$" valve is determined by placing a known weight of tobacco in a sealed chamber of known volume and weight and then evacuating the air in the chamber to a pressure of 1 torr. An amount of mercury is then admitted to the chamber in a manner such that the interfacial pressure between the mercury and the tobacco limits the intrusion of mercury into the porous structure. The volume of mercury displaced by the tobacco at an interfacial pressure of 52 to 104 torr absolute is expressed as $SV_{Hg}$ in cc/g. Specific volume differs from cylinder volume in that the tobacco is not compressed and in that the SV measurement excludes the interparticle space or volume. As specific volume increases, filling power also increases.

Equilibrium Specific Volume ($SV_{eq}$)

The SV value determined after the tobacco filler has been equilibrated by conditioning at 23.9° C. and 60% RH for 18 hours.

Tobacco

The term as used herein includes: lamina filler, i.e., shredded, cured tobacco exclusive of the stems (or veins); reconstituted tobacco; and processed stems. The tobacco may be of any type, and may be cased or uncased. Burley, bright, Oriental and blends thereof are preferred.

SUMMARY OF THE INVENTION

The present invention relates to a process for increasing the filling power of tobacco by contacting the tobacco with at least one basic calcium compound in an amount such that the treated tobacco has a pH of at least about 8, and then heating the tobacco in the presence of sufficient moisture to establish and maintain its OV value within the range of from about 14% to about 40% and at a temperature and for a time sufficient to increase the filling power of the tobacco. The basic calcium compound is preferably $Ca(OH)_2$, $CaO_2$ or CaO, and more preferably is $Ca(OH)_2$ or CaO. Dry blending is the preferred method of contacting the tobacco with the basic calcium compound. The tobacco is preferably heated at a temperature within the range of from about 75° C. to about 120° C. for a period of time within the range of from about 15 minutes to about 5 hours, and more preferably within the range of from 90° C. to about 110° C. for about 30 minutes to about 60 minutes. The tobacco may first be contacted with an acid to obtain a tobacco product of lighter color.

DESCRIPTION OF THE INVENTION

According to the present invention, a process is provided for increasing the filling power of tobacco by contacting the tobacco with at least one basic calcium compound and then heating the tobacco in the presence of sufficient moisture to establish and maintain its OV value within the range of from about 14% to about 40%.

The tobacco is lamina filler, reconstituted tobacco or processed stems. The tobacco is preferably lamina filler selected from the group consisting of Burley, bright and mixtures thereof. Since the process of the present invention may be effectively employed with either cased or uncased tobacco, flavors and additives may be applied to the tobacco either prior to or subsequent to treatment. The basic calcium compound may be applied to the tobacco while dispersed within a casing solution. It is preferred that the tobacco be lamina filler having an OV value within the range of from about 5% to about 35% before treatment.

When tobacco is cut or shredded to produce a lamina filler, it typically leaves the cutter at a moisture content (OV value) within the range of from about 18% to about 30%. This moisture content is appropriate for use in the present invention, and thus, the filling power of cut filler may be increased according to the process of the present invention without first reducing or increasing its moisture content.

The basic calcium compounds used in the process of this invention are preferably selected from the group consisting of $Ca(OH)_2$, $CaO_2$ and CaO, and are more preferably selected from the group consisting of $Ca(OH)_2$ and CaO. The particle size of the basic calcium compound is up to about 250 mesh, and preferably up to about 320 mesh.

The tobacco is contacted with at least one basic calcium compound in an amount such that the treated tobacco before heating has a pH of at least about 8, preferably, such that the tobacco contains from about 0.5% to about 6% of the compound on a dry weight basis, and more preferably, from about 1% to about 3%. The basic calcium compound may be contacted with the tobacco by any conventional means such as by dry blending or dusting. Dry blending is preferred.

Prior to contacting the tobacco with the basic calcium compound, the tobacco may be contacted with an acid to achieve a tobacco product of lighter color. Any acid which is naturally occurring in the tobacco and which forms an insoluble salt with a calcium ion can be employed. The acid is preferably selected from the group consisting of phosphoric, citric and oxalic.

After being contacted with at least one basic calcium compound, the tobacco is heated in the presence of sufficient moisture to establish and maintain its OV value within the range of from about 14% to about 40%, and at a temperature and for a time sufficient to increase the filling power of the tobacco. Preferably, the tobacco is heated at a temperature within the range of from about 75° C. to about 120° C. and for a period of time within the range of from about 15 minutes to about 5 hours. More preferably, the tobacco is heated at a temperature within the range of from about 90° C. to about 110° C. and for a period of time within the range of from about 30 minutes to about 60 minutes. It is understood that heating at a lower temperature will require a longer heating time, and vice versa. The tobacco may be heated by any conventional means, known to those skilled in the art, in which a given moisture level is maintained. One such suitable apparatus is a conveyor belt oven supplied with dry steam; another is described in U.S. Pat. No. 3,357,436.

The process of the present invention results in an increase in the $CV_{eq}$ value of the tobacco. Increases in $CV_{eq}$ of from about 14% to about 55% have been realized.

The SV value of the tobacco is substantially unaffected by the process of the present invention, and therefore, the increase in fillng power is not attributable to an expansion of the tobacco. It is a surprising aspect of the present invention that the filling power of tobacco is significantly increased through the addition of basic calcium compounds while requiring neither a solvent to allow expansion of the filler nor drying to effect removal of the solvent. The addition and removal of a solvent, which is undesirable in terms of high energy costs, may thus be avoided by employing the process of the present invention.

Although not wishing to be bound by theoretical explanations, it is felt that the increase in $CV_{eq}$ produced by the process of this invention is attributable to either a stiffening of the tobacco, caused by a reaction of the basic calcium compound with acidic species occurring naturally in the tobacco, or to an increase in interparticle friction, caused by an increase in surface roughness, or, to a combination of both of these factors.

The tobacco prior to treatment generally has a pH within the range of 5 to 6. It would be expected that addition of a relatively strong base such as $Ca(OH)_2$ would significantly increase the pH of the final tobacco product. However, it is found that the tobacco after heating generally has an acidic pH only slightly higher than, if not equal to, its original pH. This indicates that acidic groups are formed within the tobacco during the heating step, most of which are neutralized by interaction with the basic $Ca(OH)_2$.

When $Ca(OH)_2$ is utilized, calcium ions are retained by the tobacco but the hydroxide groups are converted to water which evaporates on reequilibration after heating. It is believed that CaO and $CaO_2$ convert to $Ca(OH)_2$ upon contact with water and thereafter behave in the same manner as $Ca(OH)_2$.

The treated tobacco obtained according to the present invention may be used alone or it may be mixed with other tobaccos to provide a blend for use in cigarettes or other smoking articles. Subjective evaluation has revealed that the basic calcium compounds added to the tobacco do not detract from the taste.

EXAMPLES

The following examples present illustrative but nonlimiting embodiments of the present invention. Comparative examples are also presented.

EXAMPLE 1

A 97 g sample of a conventional blend of fillers having an OV value of 12% was dry blended with 3 g of $Ca(OH)_2$ powder, placed in a vessel and swept with moisturized oxygen. The vessel was then pressurized to 775.67 torr with oxygen, sealed, and heated at 95° C. for 5 hours. After reequilibration, the $CV_{eq}$ value of the treated tobacco was 25% greater than its initial $CV_{eq}$ value. The pH of the treated filler was 6.

EXAMPLE 2

A sample of a conventional blend of fillers having an OV value of about 12.5% was dusted with 3% by weight of $CaO_2$ powder, placed in a sealed vessel and heated at 80° C. for 5 hours. After reequilibration, the $CV_{eq}$ value of the tobacco was 20% greater than its initial $CV_{eq}$ value. A comparative sample, which was subjected to identical heat treatment but without $CaO_2$, was found to undergo an increase in $CV_{eq}$ of only 2%.

EXAMPLE 3

A first sample of 57 g of uncased bright filler having an OV value of 10% was dry blended with 2 g of $Ca(OH)_2$ powder and placed in a pressure cooker on a screen situated above the bottom of the cooker. Water was placed in the bottom of the cooker in an amount sufficient to establish and maintain the OV value of the tobacco during heating at about 20%. The pressure cooker was heated at 95° C. for two hours. A second equivalent sample was treated identically except that the air in the cooker was replaced with oxygen. A third equivalent sample was heat treated without $Ca(OH)_2$ or oxygen, as a comparative example. A fourth equivalent sample, used as a control, was neither heat treated nor blended with $Ca(OH)_2$. The results are summarized in Table 1 below.

After reequilibration, the $CV_{eq}$ value of the first sample was 29% greater than that of the control sample. Porosimeter measurements on similarly treated tobacco show that the tobacco does not undergo an increase in specific volume. The $CV_{eq}$ of the comparative sample was only 6% greater than that of the control sample. The use of oxygen in the cooker was shown to have a slight effect on lowering the reducing sugars content and increasing the $CV_{eq}$ value. Data comparable to that reported in Table 1 was also obtained with cased bright filler and a conventional blend of fillers.

TABLE I

| Sample Description | $CV_{eq}$ (cc/10 grams) | $OV_{eq}$ (%) | Reducing Sugars (%) |
|---|---|---|---|
| 1. Heat treatment with $Ca(OH)_2$ | 52.5 | 10.8 | 3.2 |
| 2. Heat treatment with $Ca(OH)_2 + O_2$ | 53.6 | 10.5 | 3.0 |
| 3. Heat treatment without $Ca(OH)_2$ (Comparative) | 43.0 | 11.2 | 3.2 |
| 4. Control | 40.7 | 11.9 | 7.0 |

EXAMPLE 4

Five equivalent samples of cased bright and nine equivalent samples of a conventional blend of cased fillers were utilized in this example. Aside from control and comparative samples, each sample was sprayed to an OV value of 30% with an aqueous solution of hydrogen peroxide ($H_2O_2$) or phosphoric acid ($H_3PO_4$) of a concentration in weight percent designated in Table 2 below. Each of these samples was then dry blended with 5.4% $Ca(OH)_2$ powder on a dry weight basis, which powder uniformly adhered to the filler. Each blended sample was placed in an autoclave, so as to minimize drying, and heated at the temperatures and for the times listed in Table 2. The results are summarized in Table 2.

As shown by samples 3, 4, 5, 10 and 11, $H_2O_2$ had no beneficial effect on either the $CV_{eq}$ value or the color. In contrast, as shown by samples 12, 13 and 14, $H_3PO_4$ minimize the increase in pH and enabled the tobacco to maintain its original color.

TABLE 2

| Tobacco Type | Additive To Aqueous Solution | $Ca(OH)_2$ (%) | Temp. (°C.) | Time (Hrs) | $CV_{eq}$ (cc/10 g) | OV (%) | pH | Color |
|---|---|---|---|---|---|---|---|---|
| A. Bright (Cased) | | | | | | | | |
| 1 (control) | — | — | — | — | 29.0 | 12.8 | 5.03 | Light Brown |
| 2 | — | 5.4 | 70 | 2.5 | 44.9 | 12.1 | 8.00 | Dark Brown |
| 3 | $H_2O_2$(3.4%) | 5.4 | 75 | 2.0 | 40.1 | 12.8 | 7.31 | Medium Brown |
| 4 | $H_2O_2$(1.7%) | 5.4 | 90 | 2.0 | 40.3 | 12.8 | 7.18 | Medium Brown |
| 5 | $H_2O_2$(3.14%) | 5.4 | 90 | 2.0 | 41.6 | 12.7 | 7.01 | Medium Brown |
| B. Conventional Blend of Fillers (Cased) | | | | | | | | |
| 6 (control) | — | — | — | — | 35.0 | 13.6 | 5.54 | Light Brown |
| 7 (comparative) | — | — | 70 | 2.5 | 34.3 | 13.7 | 5.45 | Medium Brown |
| 8 | — | 5.4 | 70 | 2.5 | 44.3 | 13.1 | 7.36 | Dark Brown |
| 9 | — | 5.4 | 70 | 3.0 | 45.4 | 13.0 | 7.62 | Medium Brown |
| 10 | $H_2O_2$(3.14%) | 5.4 | 60 | 3.0 | 41.7 | 13.0 | 7.46 | Medium Brown |
| 11 | $H_2O_2$(3.14%) | 5.4 | 70 | 2.5 | 42.3 | 13.1 | 7.17 | Medium Brown |
| 12 | $H_3PO_4$(3%) | 5.4 | 70 | 2.5 | 41.2 | 12.3 | 7.05 | Light Brown |
| 13 | $H_3PO_4$(5%) | 5.4 | 70 | 2.5 | 42.3 | 12.3 | 6.12 | Light Brown |
| 14 | $H_3PO_4$(5%) | 5.4 | 90 | 2.0 | 40.3 | 12.4 | 6.15 | Light Brown |

EXAMPLE 5

A sample of cut reconstituted leaf material (made according to a paper-making process and derived entirely from tobacco) was dried to a zero OV value and then dusted with 2% by weight of $Ca(OH)_2$ powder. The sample was placed in an autoclave and heated at 90° C. for two hours in the presence of sufficient moisture to maintain the OV value at 20% during hearing. After reequilibration, the $CV_{eq}$ value of the tobacco was 14.2% greater than its initial $CV_{eq}$ value.

We claim:

1. A process for increasing the filling powder of tobacco comprising:

contacting the tobacco with at least one basic calcium compound in an amount such that the treated tobacco has a pH of at least about 8; and then heating the tobacco in the presence of sufficient moisture to establish and maintain the OV value within the range of from about 14% to about 40% and at a temperature and for a time sufficient to increase the filling power of the tobacco.

2. The process of claim 1 including, as an initial step, contacting the tobacco with an acid such that the tobacco contains from about 1% to about 5% of the acid on a dry weight basis.

3. The process of claim 2 wherein the acid is selected from the group consisting of phosphoric, citric and oxalic.

4. The process of claim 3 wherein the tobacco is heated at a temperature within the range of from about 90° C. to about 110° C.

5. The process of claim 3 wherein the tobacco is contacted with the compound by dry blending.

6. The process of claim 3 wherein the compound is selected from the group consisting of $Ca(OH)_2$ and CaO.

7. A process for increasing the filling power of tobacco comprising:

contacting the tobacco with a compound selected from the group consisting of $Ca(OH)_2$, $CaO_2$, CaO, and mixtures thereof, such that the tobacco contains from about 0.5% to about 6% of the compound on a dry weight basis; and then heating the tobacco in the presence of sufficient moisture to establish and maintain the OV value within the range of from about 14% to about 40% and at a temperature of from about 75° C. to about 120° C. and for a time within the range of from about 15 minutes to about 5 hours.

8. The process of claim 7 wherein the tobacco is heated for a time within the range of from about 30 minutes to about 60 minutes.

* * * * *

UNITED STATES PATENT AND TRADEMARK OFFICE

CERTIFICATE OF CORRECTION

PATENT NO. : 4,485,829

DATED : 4 December 1984

INVENTOR(S) : Norman B. Rainer et al

It is certified that error appears in the above-identified patent and that said Letters Patent is hereby corrected as shown below:

Column 7, line 36, change "powder" to --power--.

Signed and Sealed this

*Eighteenth* Day of *June 1985*

[SEAL]

*Attest:*

DONALD J. QUIGG

*Attesting Officer* *Acting Commissioner of Patents and Trademarks*

UNITED STATES PATENT AND TRADEMARK OFFICE

CERTIFICATE OF CORRECTION

PATENT NO. : 4,485,829

DATED : December 4, 1984

INVENTOR(S) : Norman B. Rainer et al.

It is certified that error appears in the above-identified patent and that said Letters Patent is hereby corrected as shown below:

Cover page, References Cited, U.S. PATENT DOCUMENTS, "2,596,835" should be -- 2,596,183 --.

Column 1, line 61, "aluminum citrate," should be deleted.

Column 3, line 10, "valve" should be -- value --.

Column 4, line 44, "oxalic." should be -- oxalic acids. --.

Column 7, line 32, "hearing" should be -- heating --.

Claim 1, line 1, "powder" should be -- power --.

Claim 3, line 3, "oxalic." should be -- oxalic acids. --.

Signed and Sealed this

*Twenty-second* Day of *October 1985*

[SEAL]

*Attest:*

*Attesting Officer*

DONALD J. QUIGG

*Commissioner of Patents and Trademarks—Designate*